US005571229A

United States Patent [19]

Fitzsimmons et al.

[11] Patent Number: 5,571,229

[45] Date of Patent: Nov. 5, 1996

[54] GROUND SLEEVE

[75] Inventors: James N. Fitzsimmons, Waukesha; Randy R. Schickert, Kewaskum, both of Wis.

[73] Assignee: Huffy Corporation, Miamisburg, Ohio

[21] Appl. No.: 313,360

[22] Filed: Sep. 27, 1994

[51] Int. Cl.[6] ..... E02D 5/80; A63B 63/08

[52] U.S. Cl. ..... 52/40; 52/298; 52/165; 52/736.4; 248/156; 273/1.5 R

[58] Field of Search ..... 52/40, 298, 704, 52/708, 726.3, 726.4, 736.4, 156, 165, 745.17, 745.18, 745.21, 741.11, 741.14, 741.15; 273/1.5 R, 1.5 A; 248/519, 530, 523, 545, 156; 285/419, 373; 403/109, 110, 377

[56] References Cited

U.S. PATENT DOCUMENTS

| | | | |
|---|---|---|---|
| 87,015 | 2/1869 | Varian | 52/298 |
| D. 139,311 | 10/1944 | Gibson | 273/1.5 R |
| 225,683 | 3/1880 | Brady | 52/298 |
| 592,660 | 10/1897 | Miller | 52/298 X |
| 611,568 | 9/1898 | Dohme | 52/298 |
| 837,820 | 12/1906 | Folsom & Jones et al. | 52/736.4 |
| 982,380 | 1/1911 | Martin | 52/736.4 |
| 1,799,314 | 4/1931 | Pfaff | 52/298 |
| 2,194,779 | 3/1940 | Albach | 273/1.5 R |
| 2,888,111 | 5/1959 | Evans | 52/298 X |
| 2,945,659 | 7/1960 | McDonald | 248/156 |
| 3,170,721 | 2/1965 | Wells et al. . | |
| 3,342,444 | 9/1967 | Nelson | 248/156 |
| 3,417,525 | 12/1968 | Dashio | 52/704 X |
| 3,843,079 | 10/1974 | Reisling | 248/530 |
| 4,133,154 | 1/1979 | Ruzicka | 52/704 X |
| 4,307,887 | 12/1981 | Weiss | 273/1.5 R |
| 5,037,093 | 8/1991 | Roark | 273/1.5 |
| 5,316,315 | 5/1994 | Roark, Jr. | 273/1.5 R X |
| 5,337,989 | 8/1994 | Apple | 248/530 |
| 5,417,511 | 5/1995 | Wardel | 403/109 |

FOREIGN PATENT DOCUMENTS

| | | | |
|---|---|---|---|
| 315382 | 4/1969 | Sweden | 52/298 |

OTHER PUBLICATIONS

Installation instructions and product description for a ground sleeve sold by Lifetime Products. Model #0023.

*Primary Examiner*—Robert Canfield

*Attorney, Agent, or Firm*—Howrey & Simon; Richard S. Meyer; Barry E. Negrin

[57] ABSTRACT

A support structure or ground sleeve for supporting a pole including a cap threadably engageable with an open end of a sleeve body. The ground sleeve includes a sleeve body adapted to be positioned in a ground surface for receiving and supporting a pole and includes at least one flange extending outwardly from the sleeve body for preventing the sleeve from rotating in the ground, a collet for engaging the pole, and an inwardly tapered closed end of the sleeve body for centering an end of the pole. An inwardly tapered race surface of the cap and a plurality of cirumferentially-spaced tabs of the sleeve body cooperate to define the collet. In addition, the ground sleeve is formed of a weather resistant non-corrosive material.

25 Claims, 7 Drawing Sheets

GROUND SLEEVE

FIELD OF THE INVENTION

This invention relates to a ground sleeve, and more particularly to a corrosion resistant ground sleeve or support structure for engaging and supporting a pole such as a basketball pole, or the like.

BACKGROUND OF THE INVENTION

When travelling through most neighborhoods, one can typically find a free-standing basketball hoop/backboard assembly erected in a neighborhood playground, or adjacent to a residential driveway.

It is desirable to secure a support pole for a free-standing backboard assembly as rigidly as possible in the ground to minimize or dampen out vibrations that are generated by a basketball striking the backboard assembly and/or the support pole. Toward this objective, a lower end of a free standing support pole is occasionally driven into the ground adjacent a playing surface while an upper end of the support pole supports the backboard assembly secured thereto. However, in most instances, the lower end of the support pole is encased in cement, asphalt, or the like, to more securely maintain the support pole in a fixed and erect position.

One incident of providing a rigidly fixed free standing support pole by either of the methods mentioned above is that the support pole is substantially permanently secured within the ground such that subsequent removal thereof is undesirably time and labor intensive.

However, there are a number of instances where removal and/or replacement of the support pole from the ground is desirable. For instance, during long periods of inclement weather, the support pole, typically made from cast iron, steel or aluminum tubing (hereafter referred to as "metal"), is susceptible to rusting and/or corrosion which deteriorates the appearance and eventually the structural integrity of the metal support pole. Also, the pole could be damaged by vehicles parking in close proximity to the pole, or by stresses induced during play. In any case, it is generally desirable to removably mount the support pole in the ground to permit removal of the pole.

It is known to provide a metal ground sleeve having a retainer arrangement for removably retaining a metal support pole. The known metal ground sleeve is typically driven into the ground, or encased in cement so that the support pole can be removably retained within the ground sleeve. Unfortunately, the known metal ground sleeve is susceptible to the same inclement weather as the support pole. Corrosion can develop even during periods of mild weather whereby the support pole and the ground sleeve can rust or corrosively bond together to prevent the support pole from being removed from the ground sleeve.

A further disadvantage of the known metal ground sleeve is that current known sleeve designs do not compensate for variations in the diameter of various support poles as a result of manufacturing tolerances. Typically, support poles for basketball backboard assemblies have a standard diameter of approximately 3 ½ inches. However, due to typical manufacturing variations, the diameter of a given support pole could vary enough to either prevent the support pole from conveniently fitting within the metal ground sleeve, or to prevent the support pole from being fixedly retained against movement within the metal ground sleeve.

What is needed therefore is a ground sleeve which is resistant to corrosion and which securely engages and supports a removable metal support pole such as a basketball pole, or the like.

SUMMARY OF THE INVENTION

Thus, a primary object of the present invention is to provide a corrosion resistant ground sleeve for securely engaging and retainably supporting a pole.

In one aspect of the invention, there is provided a support structure for supporting a pole including a sleeve for receiving the pole, and a collet for engaging the pole wherein the sleeve is formed of a corrosion resistant material.

In another aspect of the invention, there is provided a support structure for supporting a pole including a sleeve adapted to be positioned in a ground surface for supporting the pole, and at least one flange extending outwardly from the sleeve for preventing the sleeve from rotating in the ground.

In yet another aspect, there is provided a support structure for supporting a pole including a sleeve for receiving the pole, a collet positioned at an open end of the sleeve for gripping the pole, and an inwardly tapered closed end of the sleeve for engaging an end of the pole.

These and other objects and advantages of the invention will be apparent from the following description, the accompanying drawings and the appended claims.

DETAILED DESCRIPTION OF THE PREFERRED EMBODIMENT

Figure 1:
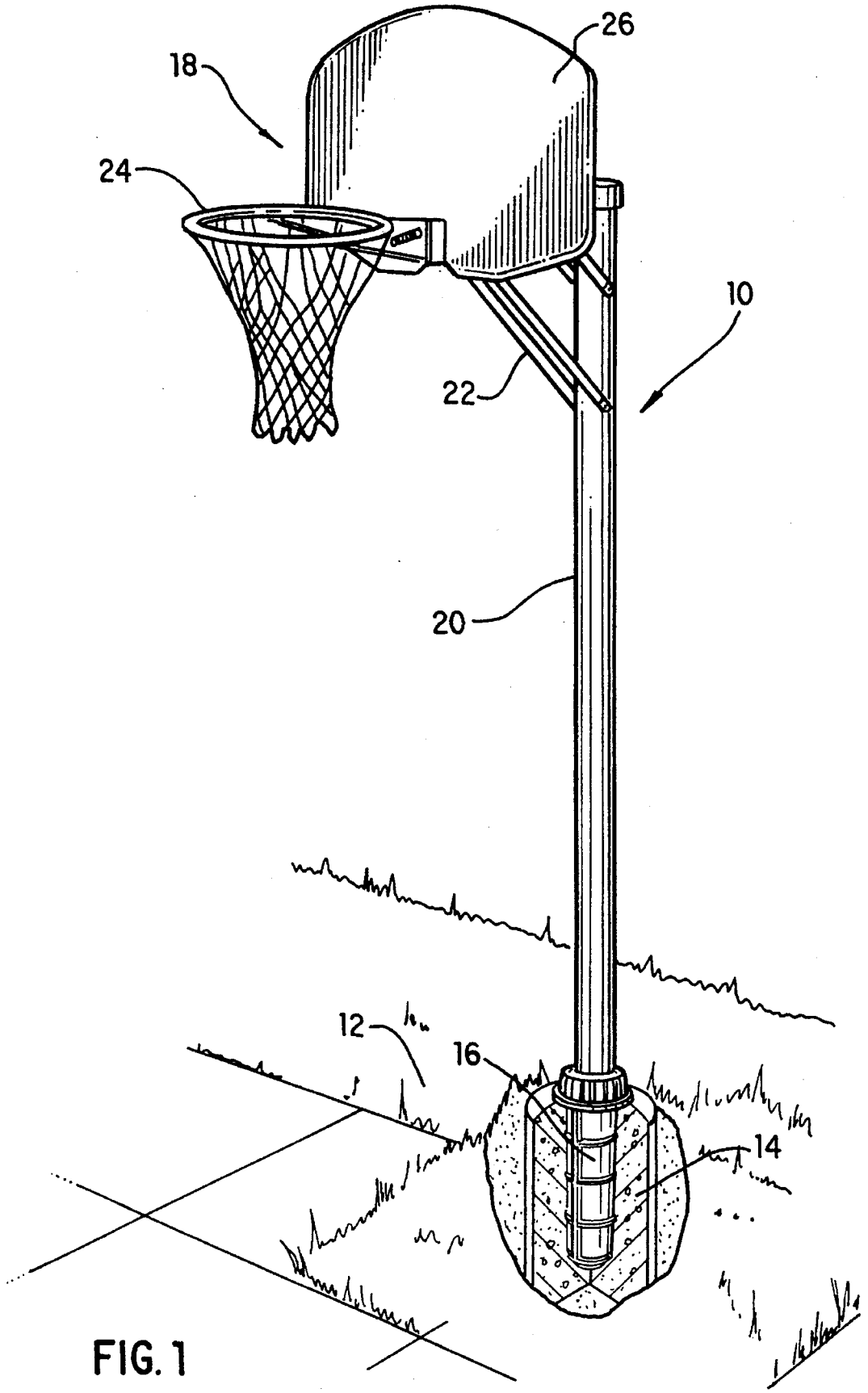
FIG. 1 is a perspective cut-away view of a ground sleeve of the present invention fixedly retained within a concrete casing, and shown supporting a support pole and basketball backboard assembly.

Referring now to FIG. 1, there is shown a basketball goal 10 which is anchored in the ground 12 in a rigidly fixed and upright position by a ground sleeve 16 of the present invention which ground sleeve 16 is substantially permanently fixed in a cement casing 14 within the ground 12.

The basketball goal 10 includes a backboard assembly 18 which is mounted to an upper portion of an upright support pole 20 by a plurality of support struts 22 in a conventional manner. The support pole 20 has a standard diameter of approximately 3½ inches. The backboard assembly 18 includes a basketball rim/net assembly 24 secured to and extending outwardly from a backboard 26.

Figure 2:
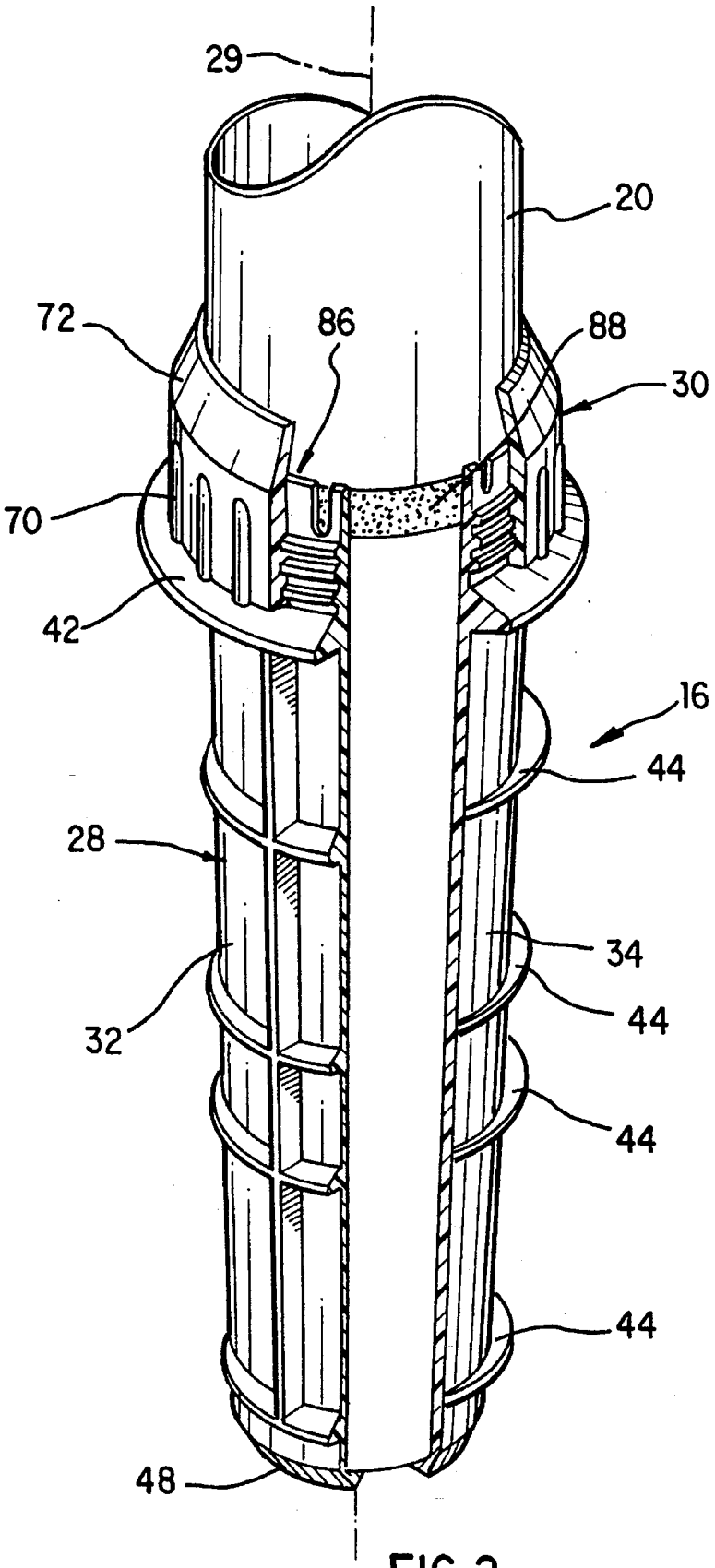
FIG. 2 is a perspective cut-away view of a support pole clampingly and frictionally engaged within the ground sleeve shown in FIG. 1.

As best seen in FIG. 2, a lower portion of the support pole 20 is inserted into and removably. retained by the ground sleeve 16. The ground sleeve 16 includes a cylindrical cup-shaped body 28 defining a longitudinal axis 29, and a tubular cap 30 threadably engageable with an open end of the ground sleeve body 28.

With reference now to FIGS. 3–7, the ground sleeve body 28 includes first and second identical half members 32 and 34 which, when oriented toward each other, interlock together in a complementary manner to form the ground sleeve body 28. Each half member 32, 34 includes longitudinally extending first and second end edges 36 and 37. The ground sleeve body 28 also includes a plurality of resilient cantilevered tabs 38, an externally threaded portion 40, a circumferential shoulder 42, a plurality of circumferential flanges 44, a plurality of longitudinal flanges 46, a radially inwardly tapered portion 48, and a transverse end wall 51.

Figures 3, 8:
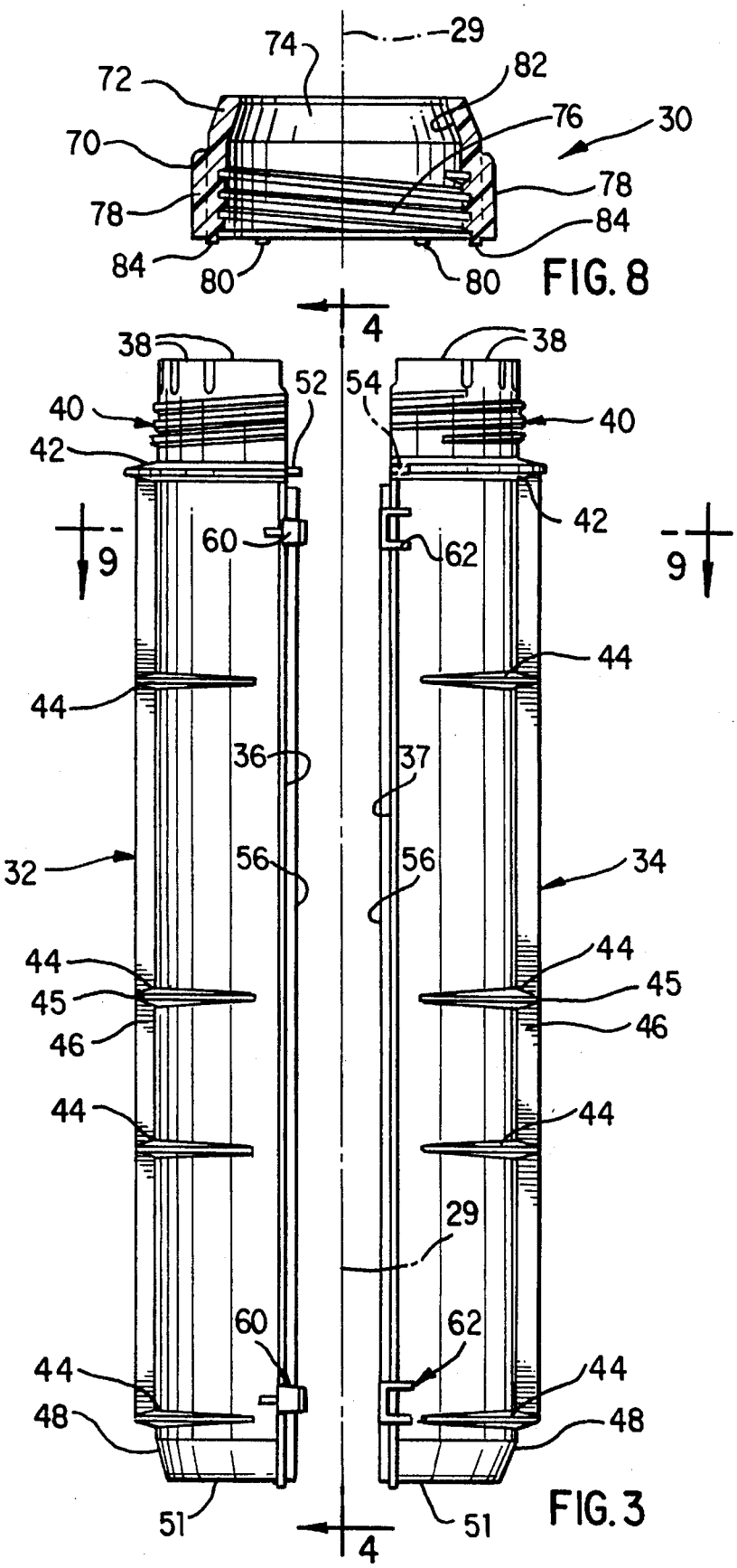
FIG. 3 is an exploded view of a ground sleeve body of the present invention showing two ground sleeve body half members.
FIG. 8 is a central sectional view of a ground sleeve cap of the present invention.
Figure 4:
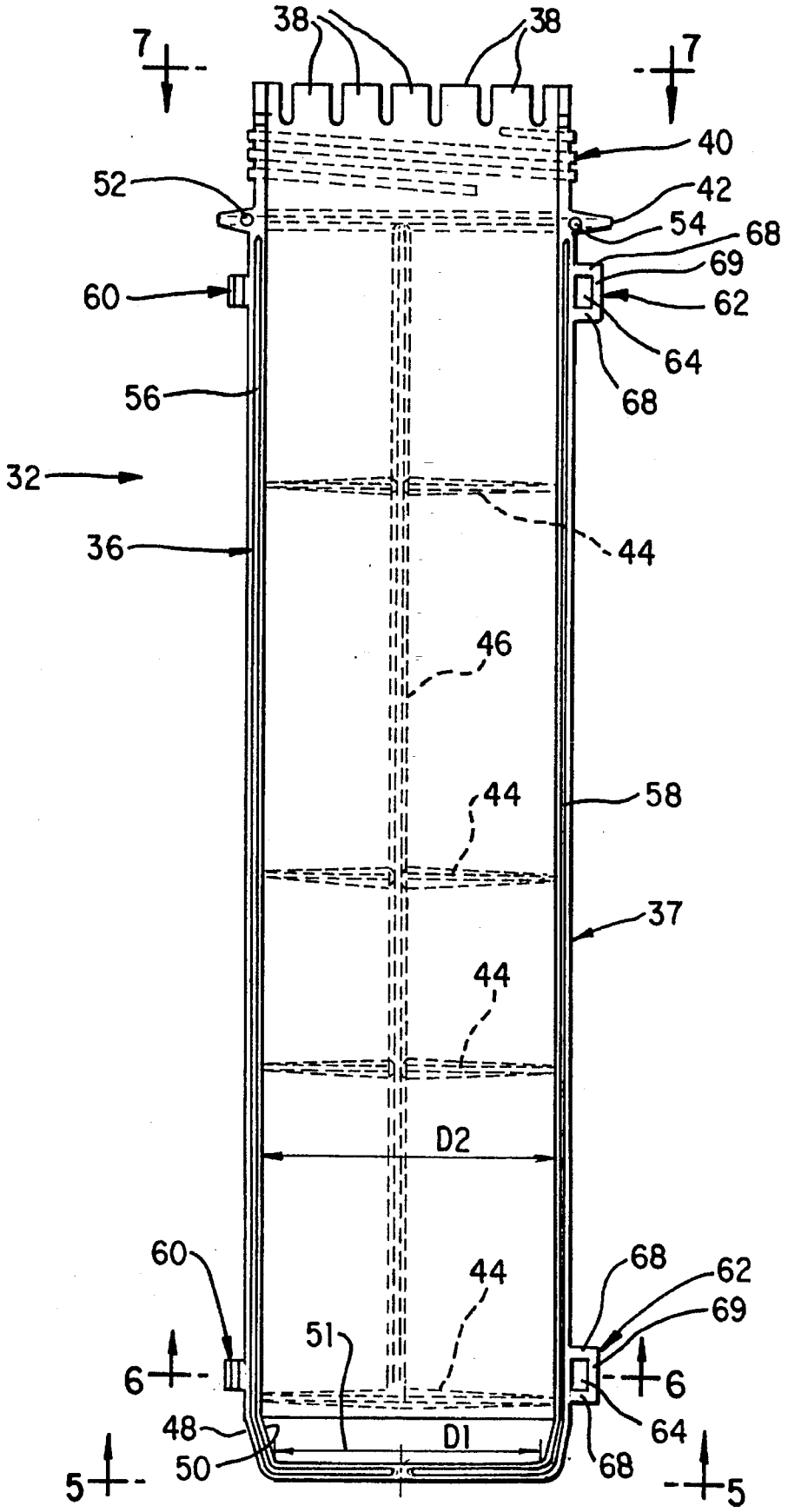
FIG. 4 is a plan view of one of the ground sleeve body half members taken along the line 4—4 of FIG. 3.

As seen in FIGS. 3 and 4, the cantilevered tabs 38 are circumferentially spaced-apart and extend longitudinally along the axis 29 to define an open end of the body 28. The externally threaded portion 40 is positioned between the tabs 38 and the shoulder 42. The shoulder 42 extends radially outwardly from the body 28 in a plane extending perpendicular to the axis 29, adjacent to the externally threaded portion 40 and remote from the tabs 38. In addition, the shoulder 42 includes an outer edge located concentrically about the axis 29. An outer edge of the shoulder 42 extends concentrically from the axis 29.

As with the shoulder 42, the circumferential flanges 44 extend radially outwardly from the body 28 in planes extending perpendicular to the axis 29. In a preferred embodiment, there are four oval-shaped flanges 44 intermittently spaced-apart along the longitudinal axis between the shoulder 42 and the end wall 51. Each of the flanges 44 has an outer edge thereof which tapers radially inwardly along the circumference of the body 28 from two radially outermost portions 45 to define an oval shaped flange in a plane extending perpendicular to the axis 29, as may be seen in FIGS. 5 and 6. The two outermost portions 45 of each flange 44 are circumferentially spaced 180° apart, with each outermost portion 45 being positioned approximately 90° apart from each end edge 36, 37 of the half members 32, 34. The outermost portions 45 extend radially outwardly from the body 28 approximately 0.5 inch and taper radially inwardly to the body 28 at each end edge 36, 37 of the half members 32, 34.

The longitudinal flanges 46 extend radially outwardly from the body 28 in a plane parallel to the longitudinal axis 29. In the preferred embodiment, two longitudinal flanges 46 intersect with the outermost portions 45 of each flange 44 and the shoulder 42. The flanges 46 extend radially outwardly from the body 28 approximately 0.5 inch.

Figure 7:
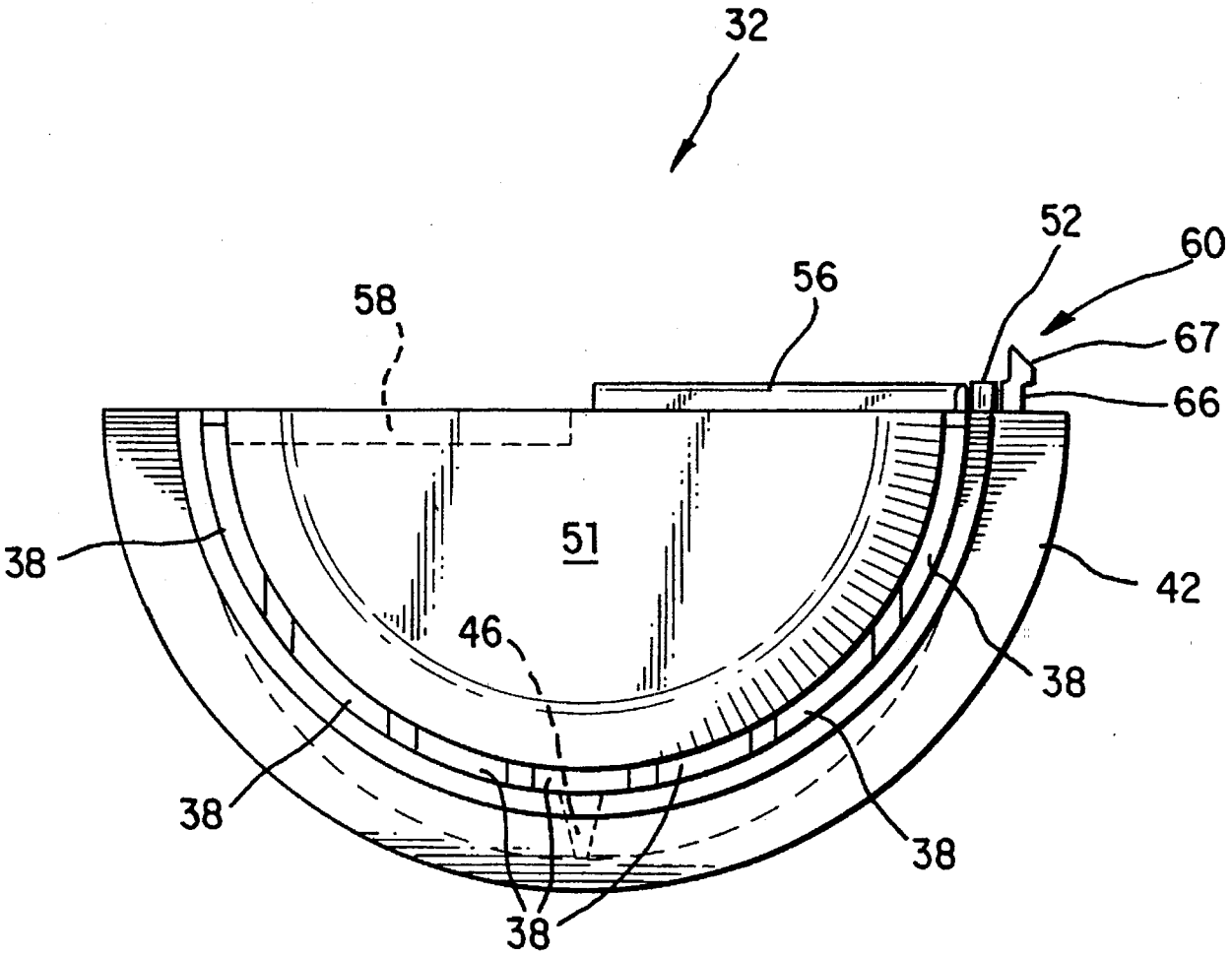
FIG. 7 is an end view of the half member taken along the line 7—7 of FIG. 4.

The flanges 44 and 46, and shoulder 42 all have a substantially similar tapered cross-section as best seen in FIGS. 2, 3 and 7. Specifically, the flanges 44,46 taper to a thinner cross-section as they extend in a direction radially outwardly from the half members 32,34.

Referring to FIG. 4, the radially inwardly tapered portion 48 of the ground sleeve body 28 includes an inner race surface 50 which tapers radially inwardly toward a transverse end wall 51 along the longitudinal axis 29. The transverse end wall 51 defines a closed end portion of the ground sleeve body 28 having a diameter $D_1$ which is less than a diameter $D_2$ of the ground sleeve body 28.

In order to interlock the half members 32, 34 together to form the ground sleeve body 28, each half member 32, 24 is provided with a first guide means, a second guide means and a locking means. As best seen in FIG. 3, the first guide means of each half member 32, 34 includes a guide pin 52 extending perpendicularly from the first end edge 36 longitudinally adjacent the shoulder 42. The guide pin 52 cooperates with a mutual guide pin aperture 54 formed in the second end edge 37 and extending perpendicularly within the shoulder 42 with respect to the axis 29.

Figure 5:
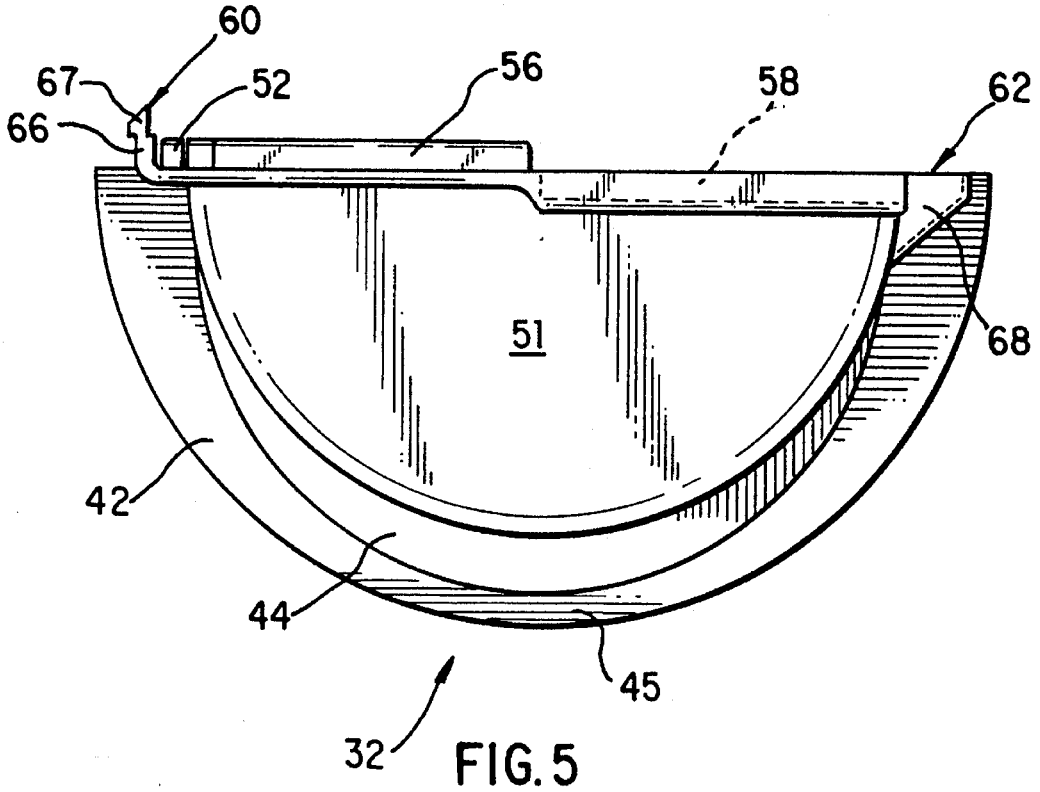
FIG. 5 is an end view of the half member taken along the line 5—5 of FIG. 4.
Figure 6:
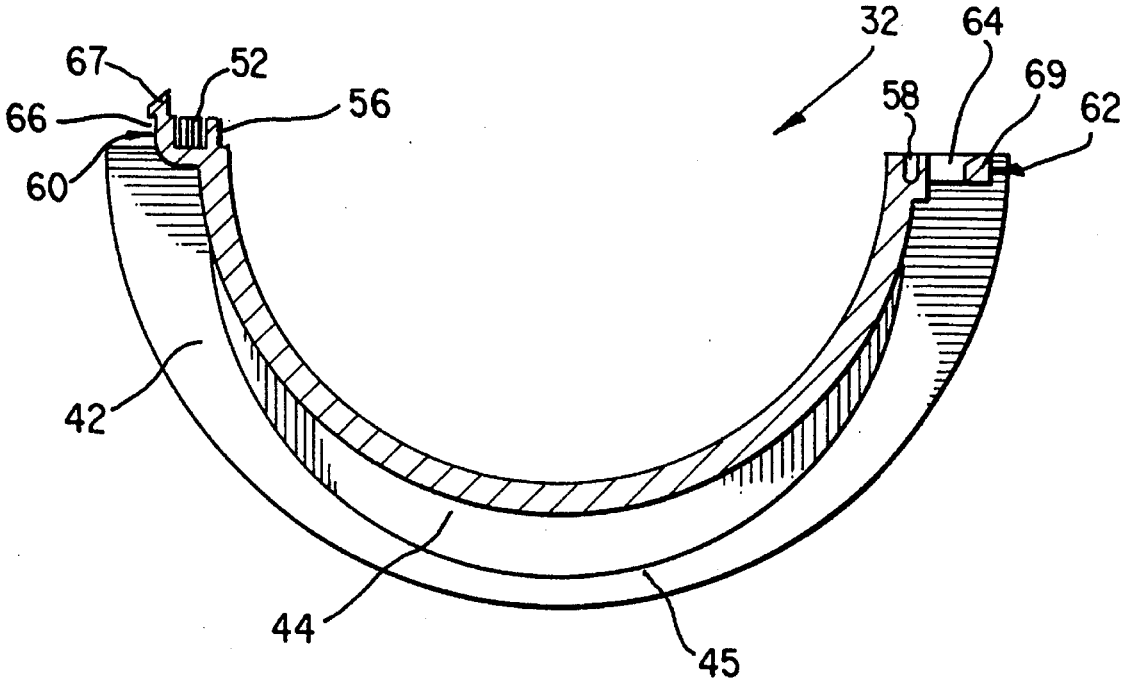
FIG. 6 is a sectional view of the half member taken along the line 6—6 of FIG. 4.

Referring further to FIGS. 5 and 6, the second guide means of each half member 32, 34 includes a guide flange 56 extending perpendicularly from the first end edge 36 longitudinally along the first end edge 36 from adjacent the guide pin 52 and further extending radially to a central portion of the transverse end wall 51. The second guide means also includes a complementary guide channel 58 communicating with and extending along the second end edge 37 from adjacent the guide pin aperture 54 to a location on the transverse end wall 51 adjacent to a terminal point for the guide flange 56 at the central portion of the transverse end wall 51.

As best seen in FIGS. 4–6, the locking means of each half member 32, 34 includes a cantilevered locking tab 60, and a corresponding retainer flange 62 which defines an aperture 64 for receiving the respective flange 62. The locking tab 60 is spaced radially outwardly from the end edge 36 and includes a hook-shaped end portion 66 having a tapered bearing surface 67 which facilitates a one-way insertion of the locking tab 60 into the aperture 64 of the retainer flange 62.

The retainer flange 62 includes two longitudinally spaced-apart strut members 68 extending radially outwardly from the end edge 37 and a cross arm 69 extending parallel with and spaced radially outwardly from the end edge 37 intermediate the strut members 68. The strut members 68 and the cross arm 69 cooperate to define the aperture 64 which is dimensioned to receive the hook-shaped end portion 66 therethrough.

It is within the scope of this invention to provide a plurality of locking means to interlock the half members 32, 34 together. However, in the preferred embodiment, the ground sleeve body 28 includes locking means each comprising a locking tab 60 and retainer flange 62 wherein two locking means are positioned proximate the shoulder 42, and the other two locking means are positioned proximate the inwardly tapered portion 48.

The ground sleeve body 28 is formed from a non-corrosive weather resistant plastic material such as polypropylene, and preferably medium impact polypropylene which is resistant to rusting, oxidation and the like.

In its assembled state, the ground sleeve body 28 is adapted to threadably receive the tubular cap 30. As seen in FIG. 8, the cap 30 includes a cylindrical wall portion 70, a radially inwardly tapered portion 72 and a longitudinally extending through passage 74. The cylindrical wall portion 70 is positioned axially adjacent and integral with the radially inwardly tapered portion 72. The inwardly tapered portion 72 and the cylindrical portion 70 cooperate to define the through passage 74 which permits the pole 20 to pass through the cap 30 when the pole 20 is inserted into the sleeve body 28.

The cylindrical wall portion 70 includes an internally threaded portion 76, a plurality of circumferentially spaced-apart longitudinal protrusions 78 (see FIG. 2), and a plurality of circumferentially spaced-apart bearing surfaces 80 extending longitudinally from an end surface 84 of the cylindrical wall portion 70. The internally threaded portion 76 defines a radially inner surface of the cylindrical wall portion 70 and is threadably engageable with the externally threaded portion 40 of the sleeve body 28. The plurality of raised protrusions 78 extend longitudinally along a substantial portion of an exterior surface of the tubular wall portion 70.

The inwardly tapered portion 72 includes a radially inner surface which defines a race surface 82 which tapers radially inwardly away from the internally threaded portion 76 along the longitudinal axis 29.

The cap 30 is formed from a non-corrosive weather resistant material such as nylon, and preferably super tough nylon which is resistant to rusting, oxidation and the like.

Figure 9:
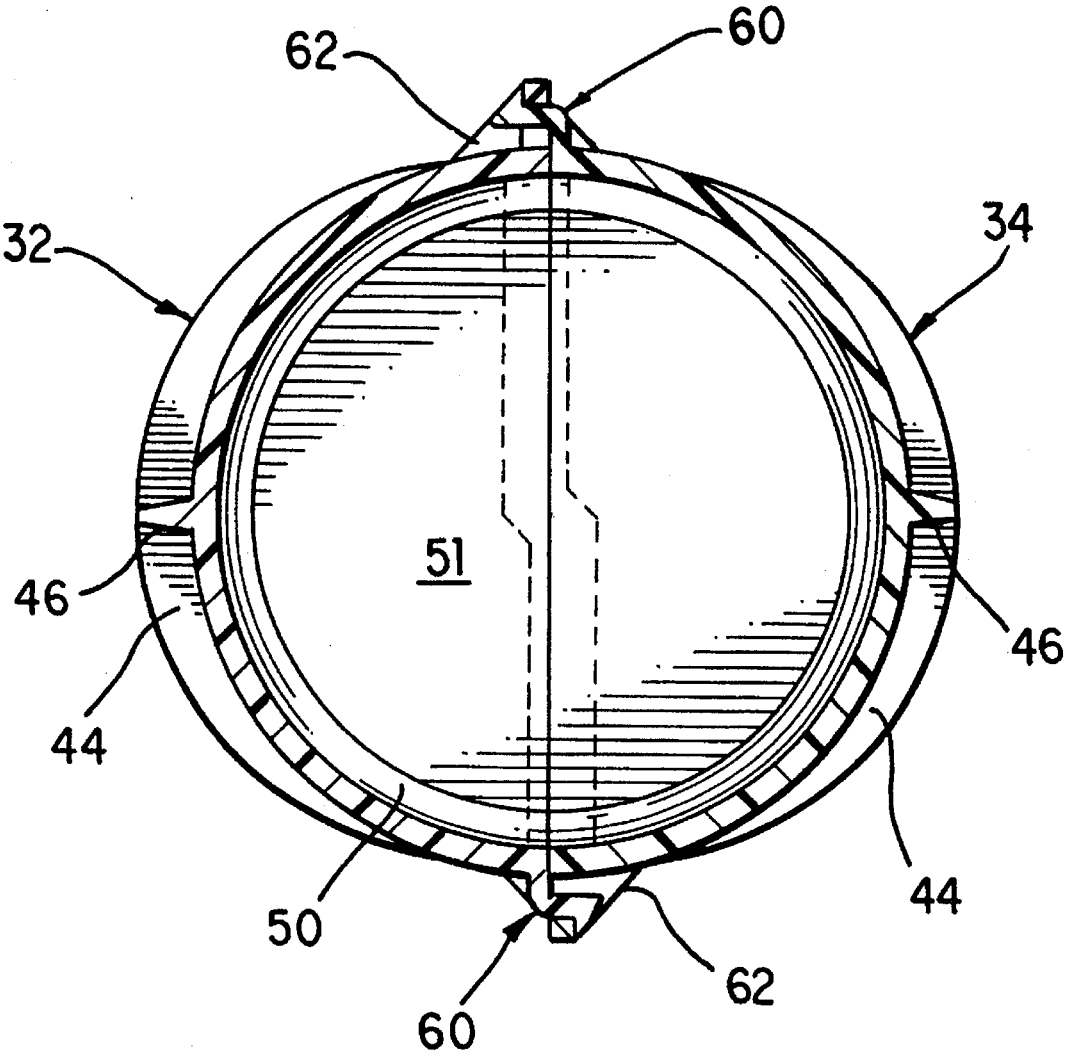
FIG. 9 is a sectional view of the assembled ground sleeve body taken along the line 9—9 of FIG. 3.

In operation, the ground sleeve 16 is assembled by aligning the first and second guide means of the half members 32, 34 with one another. The two locking means of the half members 32, 24 are then interlocked together to form the ground sleeve body 28. The locking means are interlocked together by forcing the hook-shaped end portions 66 through the apertures 64 of the respective retainer flanges 62. The tapered bearing surfaces 67 of the hook-shaped end portions 66 and the cross arms 69 cooperate to urge the cantilevered locking tabs 60 radially inwardly toward the axis 29 as the hook-shaped end portions 66 pass through the apertures 64. Once the hook-shaped end portions 66 have passed completely through the apertures 64, the cantilevered locking tabs 60 spring back radially outwardly into abutment with the cross arms 69 to lockingly engage the half members 32, 34 as shown in FIG. 9.

When the half members 32, 34 are interlocked together, guide pin 52 of half member 32 cooperates with aperture 54 of half member 34, guide pin 52 of half member 34 cooperates with aperture 54 of half member 32, guide flange 56 of half member 32 cooperates with guide channel 58 of half member 34, and guide flange 56 of half member 34 cooperates with guide channel 58 of half member 32 to maintain alignment between the half members 32, 34.

After the sleeve body 28 is assembled, the tubular cap 30, and more specifically the internally threaded portion 76, is threadably engaged with the externally threaded portion 40 of the sleeve body 28. When threadably engaged, the cap 30 and the sleeve body 28, and more particularly, the race surface 82 and the tabs 38 cooperate to form a collet 86 for engaging or gripping the pole 20 when inserted into the ground sleeve 16.

Once the ground sleeve 16 is assembled as described above, the ground sleeve 16 can then be driven into the ground 12 or encased within cement 14. In either case, the sleeve body 28 is inserted into the ground 12, or the cement 14 is poured until the shoulder 42 rests evenly with the ground surface. The flanges 44 and 46 prevent the ground sleeve 28 from rotating within the ground 12 or the cement casing 14, and the circumferential flanges 44 further operate to ensure that the ground sleeve 28 will not rise out of the ground 12 or the cement casing 14.

Once the ground sleeve 16 is securely retained within the ground 12, a lower end of the pole 20 is slidably inserted through the opening 74 in the cap 30 and into the sleeve body 16 until a free end of the pole 20 contacts the race surface 50 of the inwardly tapered portion 48, as seen in FIG. 4. The race surface 50 operates to center the pole 20 within the ground sleeve body 28 regardless of the dimensional variations of the pole 20. The position of the free end of pole 20 along the race surface 50 is a function of the outer diameter of the pole 20 such that a pole with a greater diameter will be positioned farther away from the transverse end wall 51 than a pole with a smaller diameter.

The collet 86 operates to grip or engage the pole 20 proximate the free end of the ground sleeve 16. The cap 30 is movable along the longitudinal axis 29 toward the shoulder 42 as the cap 30 is progressively threaded onto the sleeve body 16. As the cap 30 is displaced in a direction toward the shoulder 42, the tabs 38 contact the race surface 82. The tabs 38 are progressively urged radially inwardly toward the axis 29 and into gripping contact with an outer surface of the pole 20 as the inwardly tapered race surface 82 is urged slidably downwardly over the tabs 38. A tool, such as a wedge, can be used to further tighten the cap 30 onto the sleeve body 28 by urging the protrusions 78 around the sleeve body 28. The bearing surfaces 80 contact the shoulder 42 and prevent the end surface 84 of the cap 30 from being compressed into engagement with the shoulder 42 to facilitate removal of the cap 30 from the sleeve body 28 when desired.

A piece of non-slip tape 88 can optionally be placed around the circumference of the pole 20 adjacent the tabs 38 so that the tabs 38 engage the non-slip tape 88 to even more securely retain the pole 20 and prevent it from rotating within the sleeve 16.

Once the pole 20 is securely retained within the ground sleeve 16, the backboard assembly 18 can be mounted to an upper end of the pole 20 in a conventional manner.

When removal of the pole 20 is desired, the backboard assembly 18 should first be removed before the cap 30 is loosened. As the cap 30 is loosened the race surface 82 is urged upwardly to allow the tabs 38 to expand radially outwardly away from the outer surface of the pole 20. Once sufficiently free from the tabs 38, the pole 20 can be lifted out of the ground sleeve body 28 which remains retained within the ground 12 or concrete 14. It should be noted that as a result of forming the present ground sleeve of a material which is resistant to corrosion, disengagement of the pole from the ground sleeve is ensured.

While the forms of the device herein described constitute the preferred embodiments of the invention, it is to be understood that the invention is not limited to these precise forms of device, and that changes may be made therein without departing from the scope of the invention which is defined in the appended claims.

For instance, as previously mentioned, any locking means, and any number of locking means sufficient to interlock the half members 32, 34 together to form the sleeve body 28 is to be considered within the scope of the present invention.

Further, it is considered within the scope of this invention to utilize any sufficient strength weather-resistant and non-corrosive material to form the cap 30 and/or the sleeve body 28.

In addition it is envisioned that the ground sleeve of the present invention can be utilized as a support structure for other types of support poles such as volleyball support poles, flag poles, or the like. Thus, the use of a basketball support pole is not to be construed as limiting the scope of the present invention.

What is claimed is:

1. A support structure for supporting a pole comprising:

a sleeve having a longitudinal axis and a deformable open end with an inner periphery of predetermined size for receiving a pole;

a cap having a camming surface inclined with respect to the longitudinal axis of the sleeve and being engageable with said open end of said sleeve to adjust the size of the inner periphery of said open end and form a collet for engaging the pole; and wherein said sleeve is formed of a corrosion resistant material.

2. The support structure of claim 1, wherein said inner periphery is circular in shape and said inclined surface adjusts the diameter of said open end.

3. The support structure of claim 1, wherein said sleeve consists essentially of two identical halves molded from plastic material.

4. The support structure of claim 3, further comprising means for guiding the two halves together and means for locking the two halves in place to form said sleeve.

5. A sleeve for securing in the ground a pole having a predetermined outer diameter within a range of diameters, said sleeve comprising:

a sleeve body having a longitudinal axis and a deformable end having an opening with an inner periphery for receiving a pole;

an adjusting member mountable on said sleeve body for longitudinal movement relative to the sleeve body, said adjusting member having a camming surface inclined with respect to the longitudinal axis of the sleeve body, said camming surface being engageable with said deformable end for adjusting the inner periphery of the opening to conform to the predetermined outer diameter and fixedly retain the pole in the sleeve body.

6. The sleeve of claim 5, wherein said sleeve is formed of polypropylene and said adjusting member is formed of nylon.

7. The sleeve body of claim 5, wherein said adjusting member comprises a cap disposed around and extending longitudinally over said opening of said deformable end of said sleeve body.

8. The sleeve of claim 7, wherein said cap includes raised protrusions disposed on an outer surface of said cap to facilitate rotation of said cap.

9. The sleeve of claim 5, further comprising flanges extending longitudinally and circumferentially from said sleeve body, said longitudinal flanges adapted to resist rotational movement of said sleeve body and said circumferential flanges resisting upward movement of said sleeve body relative to the ground.

10. The sleeve of claim 5, wherein said sleeve body has a second end opposite said deformable end, said second end tapering radially inwardly to engage the pole.

11. The sleeve of claim 5, wherein:

said deformable end has at least one resilient tab; and said adjusting member is a cap, said cap being engageable with said deformable end, such that said camming surface adapted to urge said at least one tab into engagement with the predetermined outer diameter of the pole.

12. The sleeve of claim 11, wherein said cap includes raised protrusions disposed on an outer surface of said cap to facilitate rotation of said cap.

13. The sleeve of claim 11, wherein said at least one resilient tab comprises a plurality of resilient tabs disposed around said first deformable end.

14. The sleeve of claim 11, wherein said sleeve body is formed from a corrosion resistant material.

15. The sleeve of claim 11, further comprising flanges extending longitudinally and circumferentially from said sleeve body.

16. The sleeve of claim 11, wherein said sleeve body has a second end opposite said deformable end, and said second end tapers from a first diameter smaller than the pole to a second smaller diameter smaller than the pole.

17. The sleeve of claim 11, wherein:

said deformable end includes an externally threaded portion;

said cap includes a radially inwardly tapered portion at one end and an internally threaded portion at another end, said internally threaded portion being engageable with said externally threaded portion of said deformable end;

said camming surface of said cap being formed on said radially inwardly tapered portion;

wherein rotation of said cap engages said externally threaded portion with said internally threaded portion to move said cap along the longitudinal axis of said sleeve body; and movement of said cap along said longitudinal axis toward a second end of said sleeve body engages said radially inwardly tapered portion with said at least one tab to urge said tab radially inward to engage the pole.

18. The sleeve of claim 11, further comprising a shoulder extending from said sleeve body, wherein said cap further includes a bearing surface for engaging said shoulder.

19. The sleeve of claim 11, further comprising at least one circumferential flange extending radially from said sleeve body.

20. The sleeve of claim 11, further comprising at least one longitudinal flange extending radially from said sleeve body.

21. A basketball goal assembly to be detachably secured in the ground, said assembly comprising:

a basketball backboard and hoop;

a pole having a predetermined size within a range of sizes for supporting the basketball backboard and hoop;

a sleeve having a longitudinal axis and a deformable end having an opening with an inner periphery for receiving one end of the pole;

an adjusting member mounted on said sleeve for movement relative to the sleeve, said adjusting member having a camming surface lying in a plane inclined with respect to the longitudinal axis of the sleeve, said inclined camming surface being engageable with the deformable end for adjusting the inner periphery of the opening to conform to the predetermined size and fixedly retain the pole within the sleeve.

22. The support structure of claim 21, wherein said sleeve includes an inwardly tapered for engaging said one end portion of the pole and accommodating for dimensional variations in the value of said predetermined size.

23. The assembly of claim 21, further comprising a length of non-slip tape fixedly attached to the pole to engage said at least one tab to more securely retain the pole within the sleeve.

24. A method for securing in the ground a support pole having a predetermined size within a range of sizes, said method comprising the steps of:

a) embedding in the ground a ground sleeve having an open end and an adjusting cap with a radially tapered camming surface;

b) inserting the pole through the open end of the ground sleeve; and c) moving the adjusting cap relative to the ground sleeve such that the camming surface adjusts the size of the open end of the ground sleeve to conform to the predetermined size and fixedly retain the pole in the ground sleeve.

25. The method securing a support pole of claim 24, wherein said moving step comprises the step of rotating a cap on said open end of said ground sleeve to reduce the inner diameter of said open end, thereby creating a friction fit between the pole and said ground sleeve.

* * * * *

UNITED STATES PATENT AND TRADEMARK OFFICE

CERTIFICATE OF CORRECTION

PATENT NO. : 5,571,229

DATED : November 5, 1996

INVENTOR(S) : James N. Fitzsimmons, et al.

It is certified that error appears in the above-identified patent and that said Letters Patent is hereby corrected as shown below:

claim 6, line 1, insert -- body -- after "sleeve" (second instance);

claim 7, line 1, delete "body";

claim 16, line 3, delete "smaller than the pole"; and line 4 delete "smaller than the pole";

claim 22, line 3, delete "portion."

Column 8, line 41, after "tapered" should be --portion--.

Signed and Sealed this

Thirteenth Day of January, 1998

Bruce Lehman

*Attest:*

BRUCE LEHMAN

*Attesting Officer*

*Commissioner of Patents and Trademarks*